US009194160B1

(12) United States Patent
Kelsch et al.

(10) Patent No.: US 9,194,160 B1
(45) Date of Patent: Nov. 24, 2015

(54) SECURITY DEVICE WITH A MAGNET-BASED RELEASE MECHANISM

(71) Applicants: Christopher A. Kelsch, Palm Harbor, FL (US); Vanguard Products Group, Inc., Oldsmar, FL (US)

(72) Inventors: Christopher A. Kelsch, Palm Harbor, FL (US); John N. Figh, Jr., Oldsmar, FL (US); Lucas P. Swartwood, Tampa, FL (US); Weitong Zhu, Tampa, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

(21) Appl. No.: 14/600,765

(22) Filed: Jan. 20, 2015

(51) Int. Cl.

| | |
|---|---|
| ***H01R 13/62*** | (2006.01) |
| ***E05B 73/00*** | (2006.01) |
| ***E05B 45/06*** | (2006.01) |
| ***H01R 13/639*** | (2006.01) |

(52) U.S. Cl.
CPC ..... *E05B 73/0052* (2013.01); *E05B 45/06* (2013.01); *H01R 13/639* (2013.01)

(58) Field of Classification Search
CPC ..... E05B 73/0052; H01R 13/639; H01R 13/6395
USPC ..... 439/304–306, 318, 321, 333
See application file for complete search history.

(56) References Cited

U.S. PATENT DOCUMENTS

| | | | | |
|---|---|---|---|---|
| 3,376,992 | A | 4/1968 | Klapp, Sr. | |
| 3,837,195 | A | 9/1974 | Pelto | |
| 3,850,495 | A | 11/1974 | Glover | |
| 4,022,038 | A | 5/1977 | Miller | |
| 4,574,602 | A | 3/1986 | Furuse | |
| 4,989,739 | A | 2/1991 | Falcone et al. | |
| 5,147,060 | A | 9/1992 | Lima et al. | |
| 6,368,133 | B1 * | 4/2002 | Zeiler | H01R 13/625 439/321 |
| 7,029,303 | B2 * | 4/2006 | Bordeau | H01R 13/187 439/316 |
| 8,328,574 | B1 * | 12/2012 | Lin | H01R 13/639 439/321 |

* cited by examiner

*Primary Examiner* — Felix O Figueroa
(74) *Attorney, Agent, or Firm* — Andriy Lytvyn; Smith & Hopen, P.A.

(57) ABSTRACT

A security device for securing a male contact of a cable plug within a female port. A base has a receptacle configured to receive a boot. The base and the boot house a female and a male electric contacts. The boot and the receptacle have complimentary threads enabling the boot to be screwed into the receptacle. A movable pin resides within the boot. The receptacle has a channel adapted to receive the pin. The pin and the channel align when the boot is fully screwed into the receptacle, and the pin enters the channel, thereby securing the boot within the receptacle. In this configuration, the male contact is within the female port. A magnet key is used to retract the pin to release the boot.

20 Claims, 7 Drawing Sheets

SECURITY DEVICE WITH A MAGNET-BASED RELEASE MECHANISM

BACKGROUND OF THE INVENTION

1. Field of the Invention

This invention relates to merchandise anti-theft devices. More specifically, it relates to a security device with a magnet-based release mechanism for securing an electrical connection between two electrical contacts.

2. Brief Description of the Related Art

Retailers often prefer to present their merchandise to consumers in a way that allows the consumers to touch, inspect, and otherwise interact with the products at a display counter. Many electronic gadgets are relatively expensive and in high demand, which creates a serious threat of theft. Retailers often face a dilemma of wishing to interactively display their merchandise to attract customers and increase sales, while, at the same time, safeguarding the merchandise against theft.

To reduce likelihood of theft while allowing potential purchasers to experience full functionality of an electronic gadget, it is often necessary for the product to be electrically connected via a wire to an electrical source, another electronic device, or an anti-theft alarm module. Safeguarding integrity of this wired electric connection may be paramount for enabling proper functionality of the device, securing the device against theft, and ensuring consumer safety. At the same time, authorized personnel must be able to quickly disconnect and reconnect the wired connections of the displayed devices. Accordingly, what is needed is a security device for safeguarding a wired electrical connection against unauthorized tampering, while enabling the authorized personnel to swiftly unplug the connected wire when the need arises.

SUMMARY OF THE INVENTION

The long-standing but heretofore unfulfilled need for a device securing a wired electrical connection with a quick release mechanism is now met with a novel and non-obvious invention.

In an embodiment, the security device according to the present invention has a base. The base contains a receptacle configured to receive a boot. The receptacle has a first thread circumferentially disposed on its interior lateral surface, and the boot has a second thread circumferentially disposed on its outer lateral surface, the second thread configured to engage the first thread. A movable pin resides within the boot, and the base has a channel, wherein the channel opens into the receptacle. The channel is configured to align with and receive the pin when the boot is screwed into the receptacle, thereby immobilizing the boot within the receptacle. A magnet key is used to retract the pin from the channel, thereby releasing the boot.

In an embodiment, the boot contains a blind hole in which the pin resides. A biasing element may be used to urge the pin into an extended position in which the pin protrudes outside the boot. The biasing element may be a spring, a permanent magnet, a polymer member, a biasing tine, or a combination thereof. The magnet key produces a magnetic field sufficient to overcome the force of the biasing element when the magnet key abuts a top surface of the boot.

A first electric contact is housed within the boot and a second electric contact is housed within the base. The first and the second electric contacts are in an electrical communication with one another when the boot is within the receptacle.

The boot may contain a male contact or a female port, and the base may contain a contact of the opposite gender.

In an embodiment, an alarm module is housed within the base or the boot. The alarm module monitors the electrical communication between the first and the second contacts, and responsive to an interruption of an electrical current flow between the first and the second contacts, the alarm module generates an alarm signal to trigger an alarm. The alarm may be a visual alarm, an audible alarm, an email, a text message, multimedia message, a facsimile, or a combination thereof.

In an embodiment, the boot is composed of two mating components, whereby a housing for a wire plug is accessible when the two mating components are apart.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
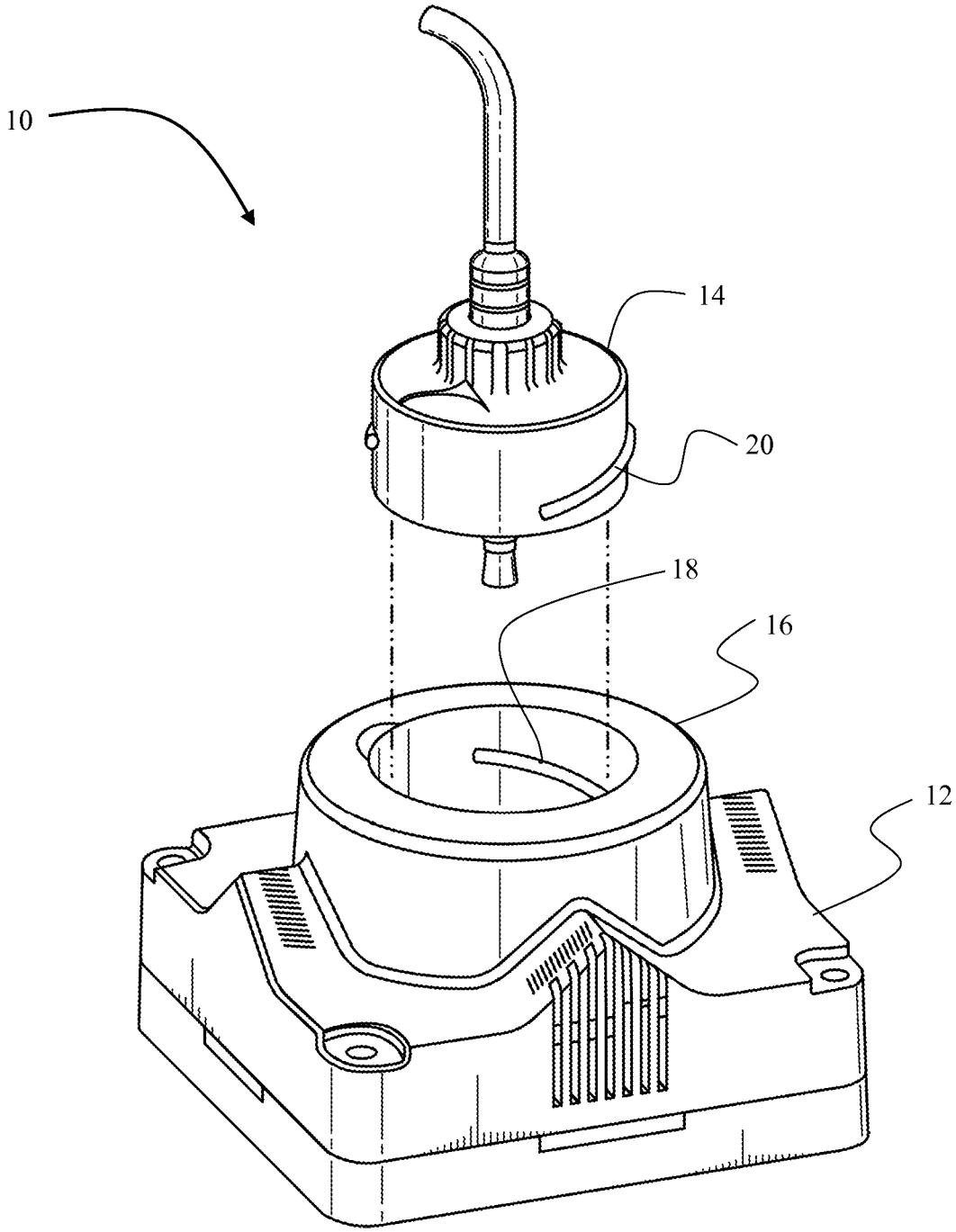
FIG. 1A is a perspective view of a security device in an unlocked configuration.
Figure 1B:
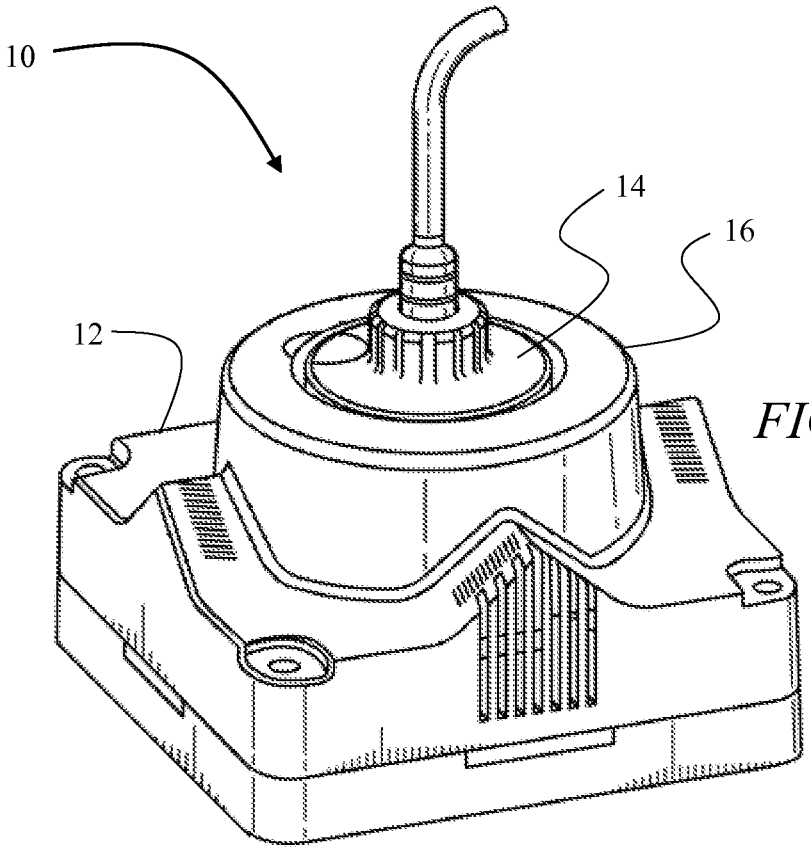
FIG. 1B is a perspective view of a security device in a locked configuration.

An unlocked configuration of security device 10 is depicted in FIG. 1A. Security device 10 comprises two main components—a base 12 and a boot 14. Base 12 has a receptacle 16 configured to receive boot 14. A first thread 18 is circumferentially disposed on the inner lateral surface of receptacle 16. Boot 14 contains a second thread 20 complimentary to first thread 18. Second thread 20 is circumferentially disposed on the outer lateral surface of boot 14. Boot 14 can be selectively secured within receptacle 16 by placing boot 14 inside receptacle 16 so that the first and second threads 18 and 20 engage one another. Rotation of boot 14 about its center axis along the direction of first and second threads 18 and 20 screws boot 14 into receptacle 16. This locked configuration of security device 10 is depicted in FIG. 1B. Engagement between first and second threads 18 and 20 retains boot 14 within receptacle 16 against linear forces applied to boot 14. In order to transition security device 10 from a locked configuration to an unlocked configuration, a moment must be applied to boot 14 to rotate it about its center axis against the direction of first and second threads 18 and 20 until first thread 18 disengages second thread 20, thereby releasing boot 14 from receptacle 16.

Figure 2:
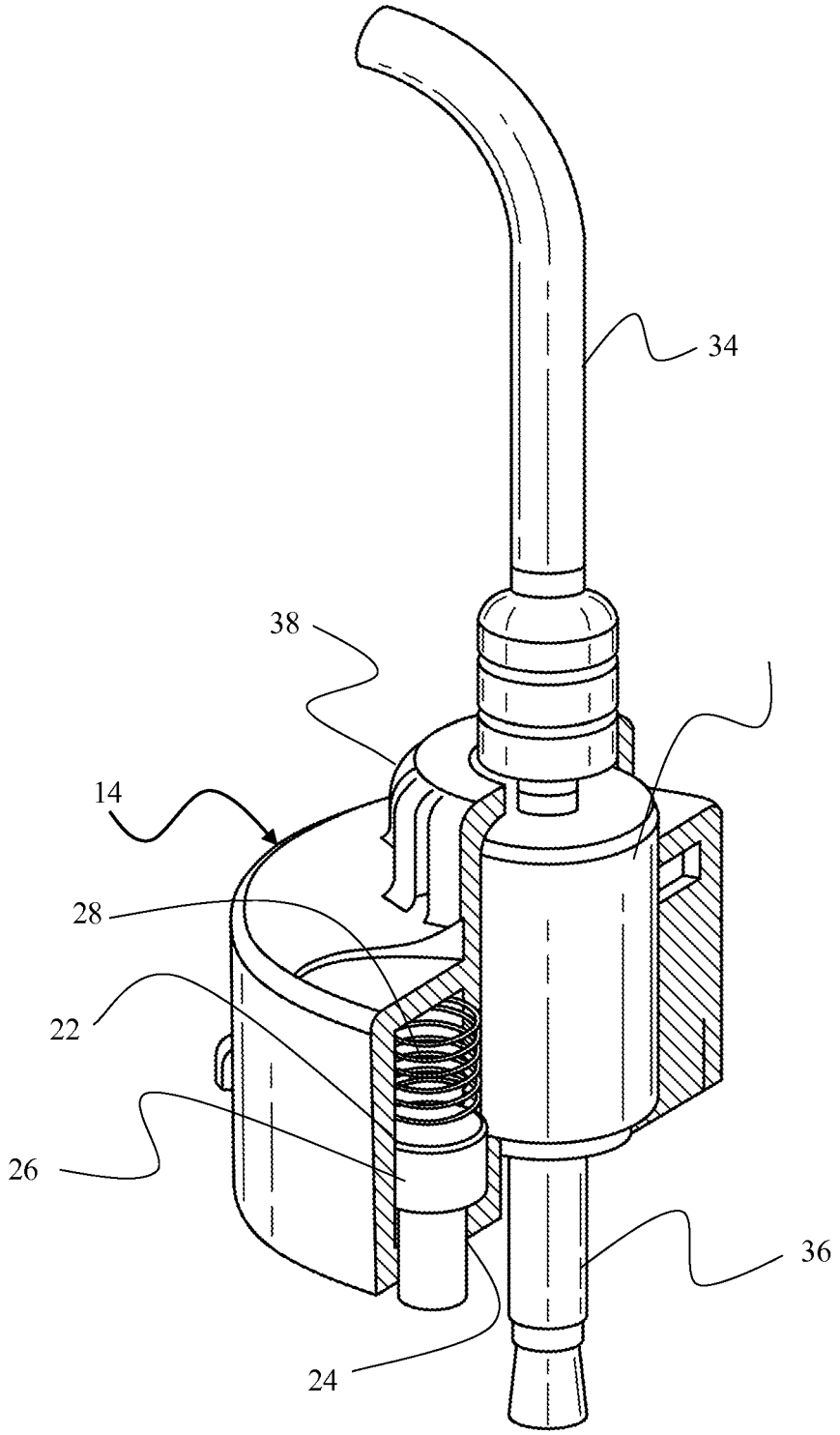
FIG. 2 is a cross-sectional view of the boot.

FIG. 2 shows a cross-sectional view of boot 14. Boot 14 has a blind hole 22, which has an opening 24 at the bottom surface of boot 14. A pin 26 slidingly resides within blind hole 22. Pin 26 has a head portion of a larger circumference than the rest of the body of pin 26, and blind hole 22 has a shoulder configured to prevent pin 26 from exiting blind hole 22. Pin 26 has an extended position depicted in FIG. 2, where pin 26 protrudes through opening 24, and a retracted position, in which the entire length of pin 26 remains within blind hole 22. Pin 26 is biased toward the extended position by a biasing element 28, which also resides within blind hole 22. In the embodiment depicted in FIG. 2, biasing element 28 is a helical spring. In alternative embodiments, biasing element 28 may be a permanent magnet, which may reside within boot 14 or within base 12. Pin 26 and biasing element 28 assembly may also be replaced by a biased tine, a pivoting locking member, or another means known in the art capable of having extended and retracted positions. In an embodiment, biasing element 28 may be eliminated as the weight of pin 26 may provide sufficient force to urge pin 26 toward the extended position.

Figure 3:
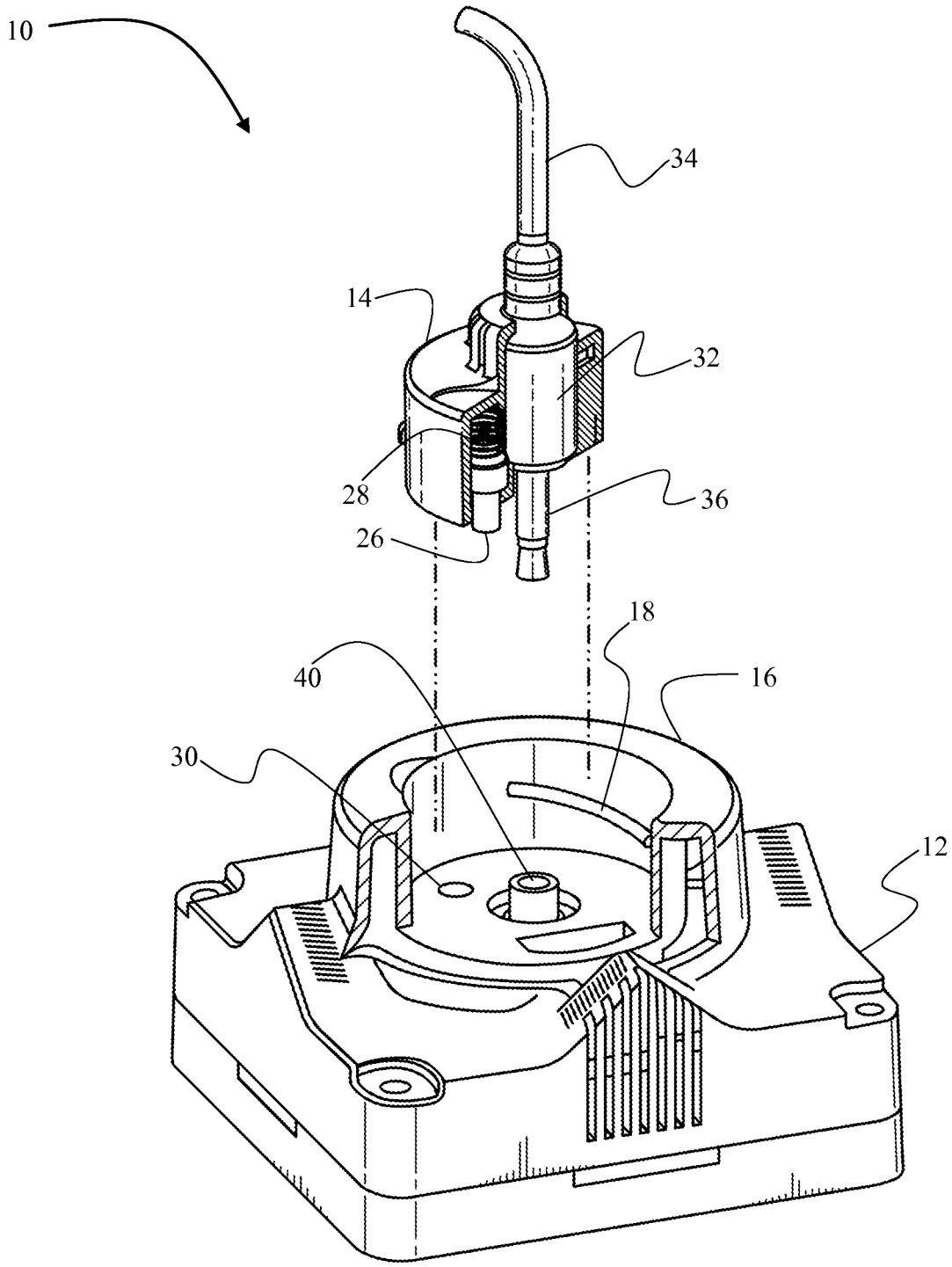
FIG. 3 is a perspective sectional view of a security device in an unlocked configuration.
Figure 4A:
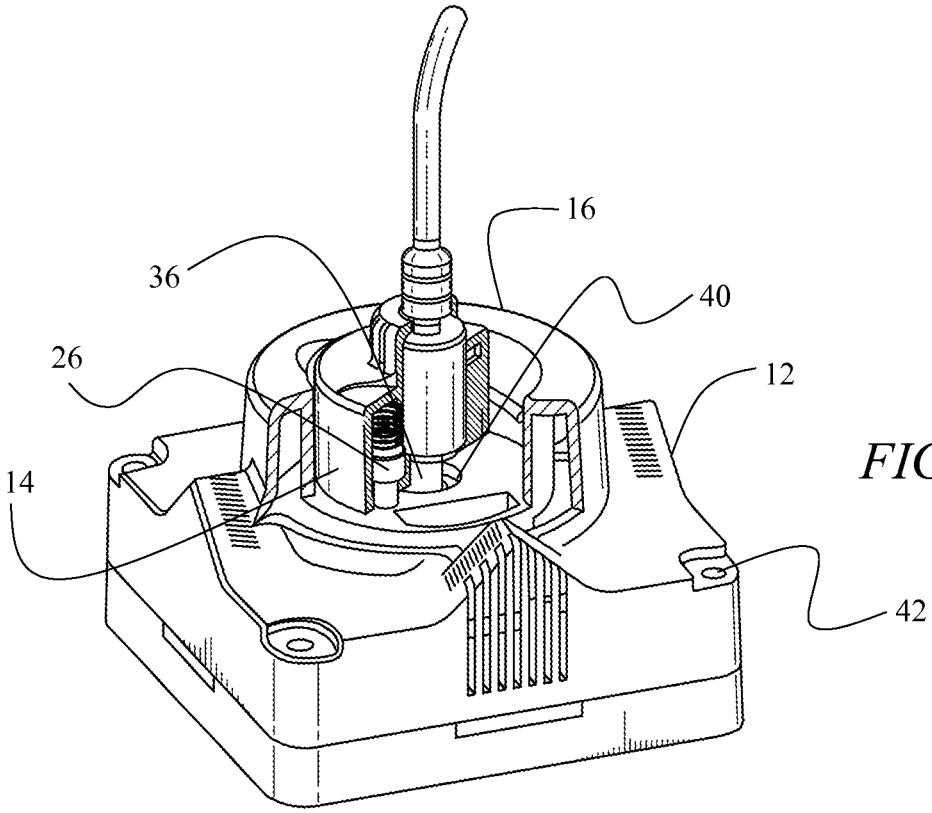
FIG. 4A is a first perspective sectional view of a security device in a locked configuration.
Figure 4B:
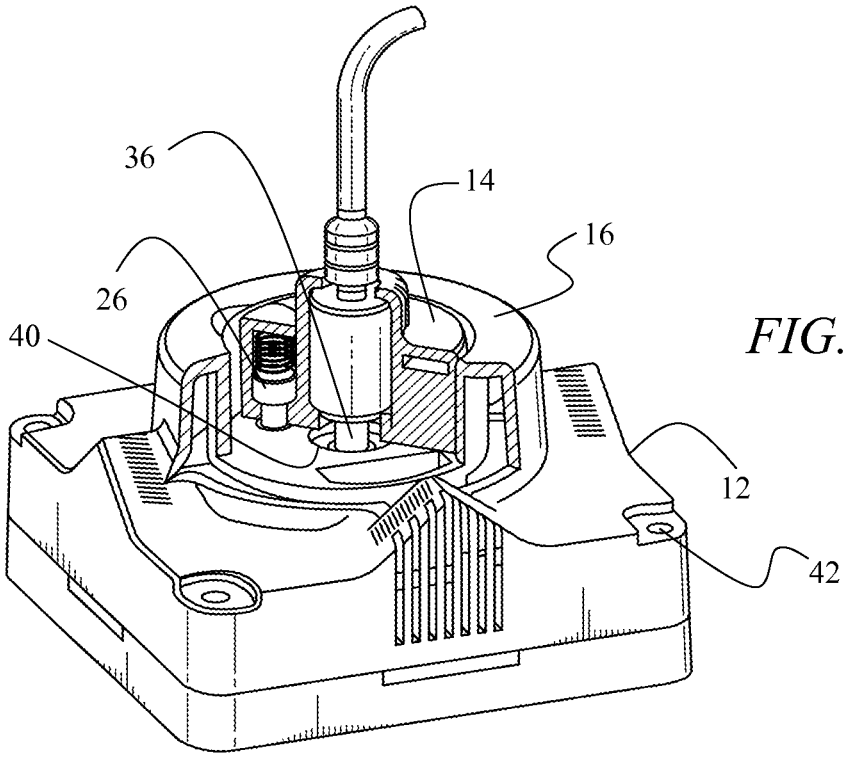
FIG. 4B is a second perspective sectional view of a security device in a locked configuration.

FIG. 3 depicts sectional views of receptacle 16 and boot 14. Receptacle 16 contains a channel 30 configured to receive pin 26 when pin 26 is in the extended position. Channel 30 and blind hole 22 are positioned with respect to first and second threads 18 and 20 so that channel 30 and opening 24 of blind hole 22 align when boot 14 is fully screwed into receptacle 16. This structural feature allows pin 26 to enter channel 30 when security device 10 is in the locked configuration. At this point, pin 26 partially resides within blind hole 22 and partially within channel 30, thereby preventing boot 14 from rotating about its center axis. When pin 26 is within channel 30, boot 14 is immobilized against both rotation about a center axis thereof and also against linear movement within receptacle 16 as explained above. Therefore, boot 14 cannot be removed from receptacle 16 unless pin 26 is fully refracted from channel 30. The locked configuration of security device 10 is depicted in FIGS. 4A and 4B.

In an alternative embodiment, pin 26 and biasing element 28 may reside within base 12. In this embodiment, pin 26 has an extended position in which pin 26 protrudes into receptacle 16, and a retracted position in which pin 26 is fully contained within base 12. When boot 14 is screwed into receptacle 16, pin 26 enters blind hole 22 of boot 14 to immobilize boot 14 within receptacle 16.

FIGS. 2 and 3 depict that boot 14 is configured to house a plug 32 of an electric cable 34. In an embodiment, boot 14 is made up of two mating components that come apart to enable insertion of plug 32 into boot 14. The two mating components may be attached to one another via a snap mechanism, bolts, adhesive, or another means known in the art. Boot 14 may have a neck 38 with an opening that is smaller than the transverse cross-section of plug 32, thereby preventing plug 32 from sliding out of boot 14. In the embodiment depicted in FIGS. 2 and 3, plug 32 has a male contact 36. Male contact 36 of cable 34 protrudes outside the bottom surface of boot 14. Base 12 contains a female port 40 configured to receive male contact 36 when security device 10 is in its locked configuration as shown in FIGS. 4A and 4B. Accordingly, electrical connection between male contact 36 and female port 40 cannot be interrupted until boot 14 is removed from receptacle 16. In an alternative embodiment, male contact 36 may reside within Base 12, while corresponding female port 40 may be housed within boot 14.

Base 12 may be mounted onto a support surface with screws or bolts passing through a plurality of screw holes 42. In an alternative embodiment, base 12 may be secured to a support surface via adhesive, or any other means of attaching two surfaces known in the art. Base 12 may contain an alarm module configured to monitor electrical connection between male contact 36 and female port 40. If the alarm module detects interruptions in the electrical current flowing between male contact 36 and female port 40, the alarm module sends an electrical signal to trigger an alarm. The alarm may be audible, visual, or may be an automated communication sent to an appropriate party via any means known in the art, including a phone call, a text message, a multimedia message, an email, etc.

Figure 5A:
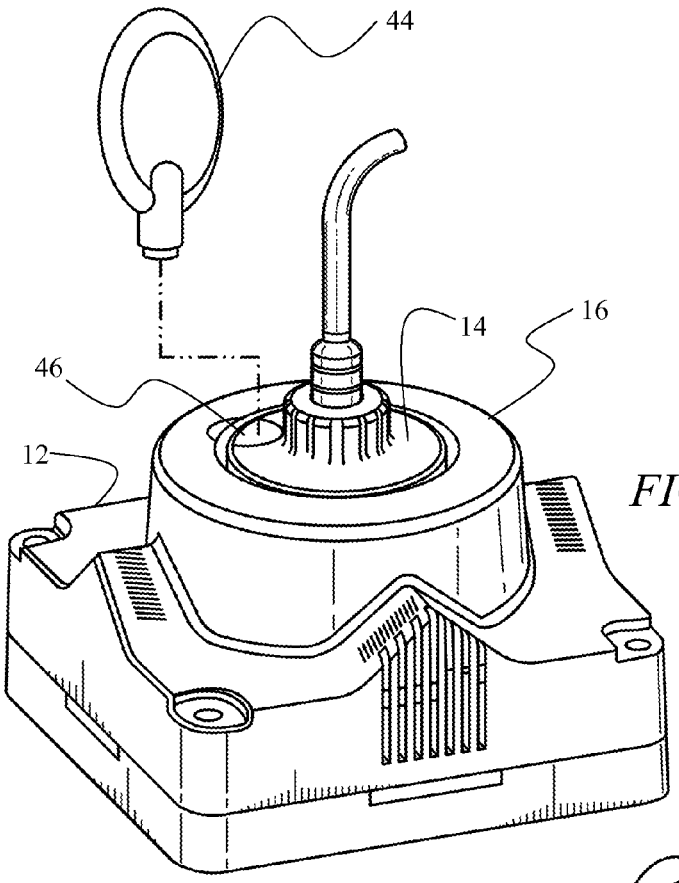
FIG. 5A is the first of three figures depicting a sequence for unlocking the security device.
Figure 5B:
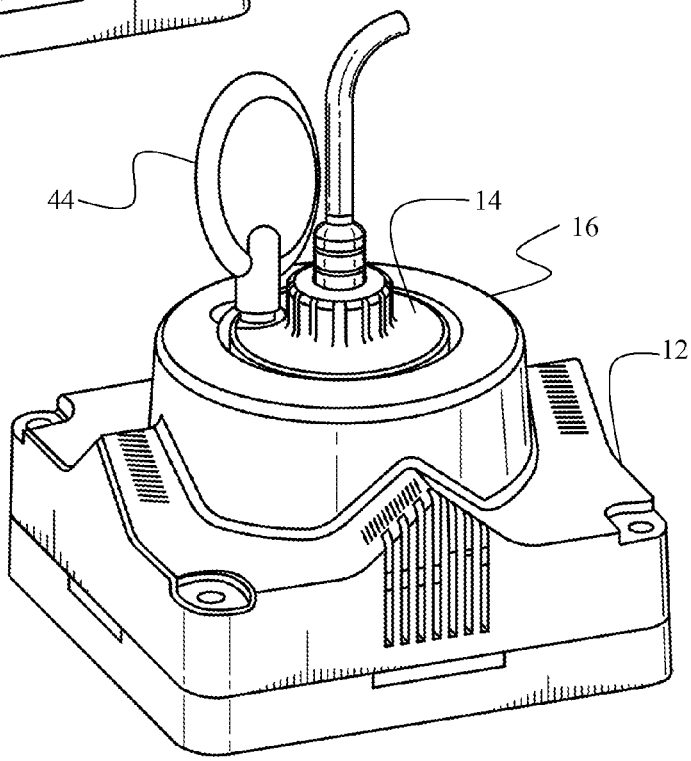
FIG. 5B is the second of three figures depicting a sequence for unlocking the security device.
Figure 5C:
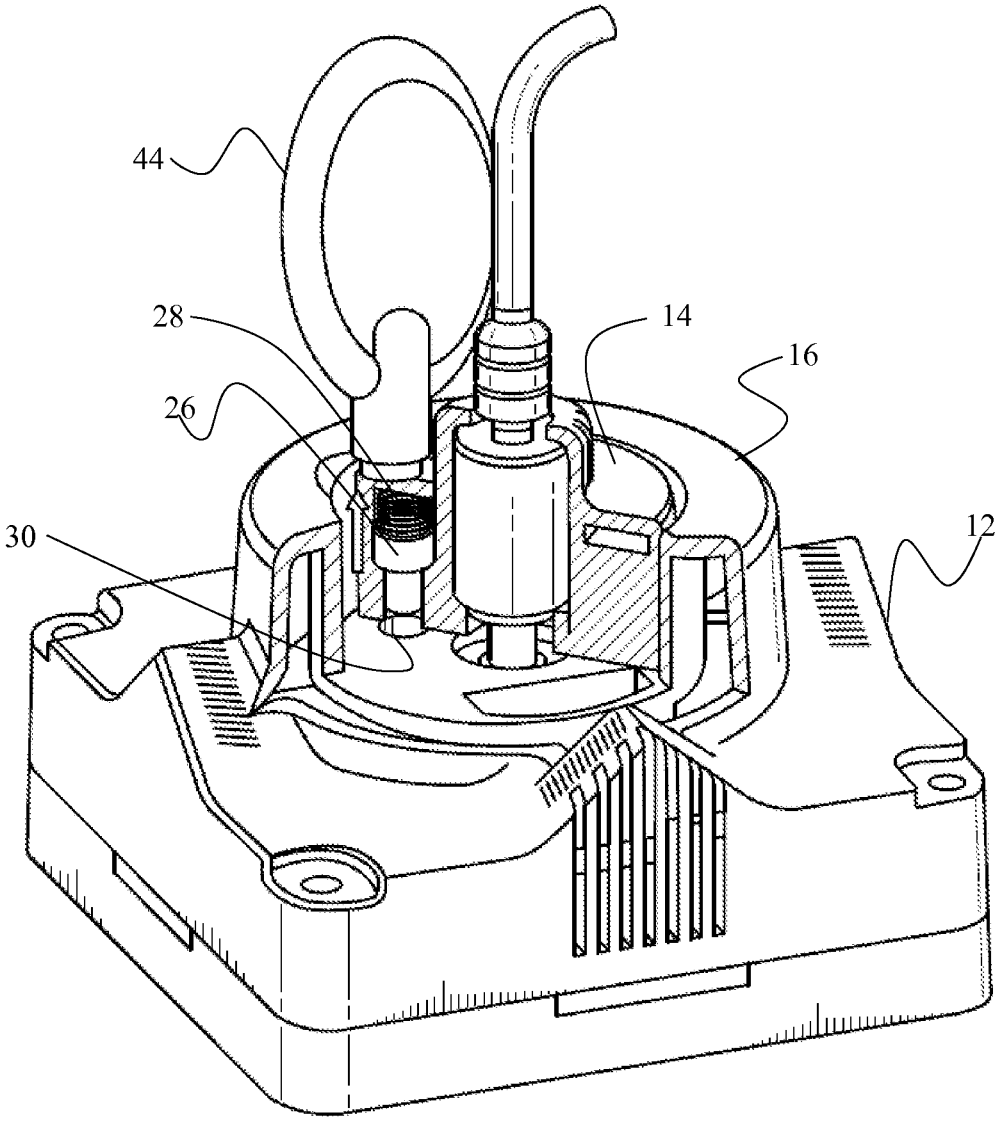
FIG. 5C is the third of three figures depicting a sequence for unlocking the security device.

The process of unlocking security device 10 is illustrated in FIGS. 5A-C. A semi-specialized dipole magnet key 44 depicted in FIG. 5A is required to transition security device 10 from a locked configuration to an unlocked configuration. FIG. 5B depicts magnet key 44 being placed at a top surface of boot 14 over blind hole 22. An indentation 46 (or another type of a mark) may be placed on a top surface of boot 14 to mark the location of blind hole 22. FIG. 5C illustrates that the magnetic field of magnet key 44 is sufficient to overcome biasing force of biasing element 28, thereby retracting pin 26 into its retracted position within boot 14. At this point, pin 26 exits channel 30 within receptacle 16, which allows boot 14 to be rotated about its center axis against the direction of first and second threads 18 and 20. Once the angle of rotation is sufficient to disengage first thread 18 from second thread 20, security device 10 is in the unlocked configuration, and boot 14 may be removed from receptacle 16. This action disengages male contact 36 from female port 40.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. Although the above description refers to an electronic gadget, other types of electronic or non-electronic merchandise may be secured by the invention.

GLOSSARY OF TERMS

Alarm module—electronic circuitry configured to detect whether an electrical current flows between the first and the second contacts and, responsive to detecting an interruption in the current flow, to generate an alarm signal.

Alarm—an audio, visual, or audible alert intended to notify designated parties of a potential theft. Alarm encompasses electronic communications, such as text messages, multimedia messages, email, a facsimile, etc., that are transmitted to a control center, police, store personnel, or another party.

Alarm signal—electric signal generated by the alarm module in response to detecting an interruption in the current flow between the first and second electric contacts.

Base—a component of the security device that contains a receptacle and may house an electrical contact and an alarm module. Base may be mounted to a support surface.

Biasing element—a mechanical component used to store mechanical energy and exert a force in response to being compressed, extended, bent, or otherwise elastically deformed. A biasing element may be a helical coil spring, a polymer element, a rigid element under an elastic deformation, or other such components known in the art. Biasing element can also be a magnet exerting a magnetic force on the pin urging it into its extended position.

Blind hole—a hole that extends to a predefined depth without breaking through to the other surface of the boot.

Channel—an elongated extrusion disposed on the base configured to receive and slidingly retain the first ends of the arms. The channel may be disposed either on the lateral surface or the top surface of the base. Ledges may be disposed on the outer perimeter of the channel to retain the first end of the arm within the channel.

Electric contact—a piece of electrically conductive material configured to be in an electrical communication with another complementary piece of electrically conductive material to close an electrical circuit.

Female port—a hollow insulated casing containing an electrical contact within the interior of the casing.

Magnet key—a dipole magnet having a magnetic field sufficient to overcome any biasing force exerted on the pin and to retract the pin.

Male contact—an electric contact protruding from an insulated casing.

Male plug—a device for making an electrical connection comprising an insulated casing and electric contacts.

Monitoring—being in an electrical communication with two electric contacts and being capable of detecting an interruption in electric current flow between the electric contacts.

Pin—an elongated rigid component that can be attracted or repelled by a magnetic force. The pin may have a head portion of larger circumference than the body.

Receptacle—a component of a base configured to receive a boot.

What is claimed is:

1. A security device comprising:

a base;

a receptacle disposed within the base, the receptacle having an inner lateral surface;

a first thread circumferentially disposed on the inner lateral surface of the receptacle;

a channel disposed within the base, the channel opening into the receptacle;

a boot configured to be received within the receptacle, the boot having an outer lateral surface;

a second thread circumferentially disposed on the outer lateral surface of the boot, the second thread being configured to engage the first thread;

a pin housed within the boot, the pin having an extended position in which the pin protrudes from the boot, and a retracted position in which the pin is contained within the boot, the pin configured to be received within the channel in the base;

wherein the channel and the pin are positioned with respect to the first and the second threads in locations where the channel and the pin align when the boot is screwed into the receptacle enabling the pin to enter the channel, thereby restricting the boot from rotating about a center axis thereof, thereby immobilizing the boot within the receptacle; and a magnet key configured to retract the pin into the retracted position, thereby releasing the boot.

2. The security device of claim 1, further comprising a biasing element urging the pin into the extended position, wherein the biasing element urges the pin into the channel when the boot is screwed into the receptacle.

3. The security device of claim 2, wherein the biasing element is selected from the group consisting of a spring, a permanent magnet, a polymer member, a biasing tine, or a combination thereof.

4. The security device of claim 2, wherein the magnet key produces a magnetic field sufficient to overcome a biasing force exerted by the biasing element onto the pin when the magnet key is placed at a top surface of the boot.

5. The security device of claim 1, further comprising a first electric contact carried by the boot and a second electric contact housed within the base, wherein the first and the second electric contacts are in an electrical communication with one another when the boot is within the receptacle.

6. The security device of claim 5, further comprising an alarm module housed within the base or the boot, the alarm module monitoring the electrical communication between the first and the second contacts, wherein responsive to an interruption of an electrical current flow between the first and the second contacts, the alarm module generates an alarm signal.

7. The security device of claim 6, wherein the alarm signal triggers an alarm, the alarm being selected from the group consisting of a visual alarm, an audible alarm, an email, a text message, a multimedia message, a facsimile, or a combination thereof.

8. The security device of claim 5, wherein the first contact is a male contact or a female port.

9. The security device of claim 1, further comprising a male plug housed within the boot and a female port housed within the base, wherein an electric contact of the male plug protrudes outside the boot and the female port has an opening within the receptacle, whereby the male contact enters the female port when the boot is received within the receptacle.

10. A security device comprising:

a base having a receptacle, the receptacle having an inner lateral surface and an inner bottom surface;

a first thread circumferentially disposed on the inner lateral surface of the receptacle;

a channel disposed within the base, the channel opening onto the inner bottom surface of the receptacle;

a boot configured to be received within the receptacle, the boot having an outer lateral surface, a bottom surface, and a top surface;

a blind hole disposed within the boot, the blind hole opening onto the bottom surface of the boot;

a pin retractably disposed within the blind hole, the pin having an extended position in which the pin protrudes from the bottom surface of the boot, and a retracted position in which the pin is contained within the blind hole, wherein the pin is configured to be received within the channel;

a second thread circumferentially disposed on the outer lateral surface of the boot, the second thread configured to engage the first thread; and wherein the channel and the blind hole are positioned with respect to the first and the second threads in locations where openings of the channel and the blind hole align when the boot is screwed into the receptacle, whereby the pin enters the channel, thereby restricting the boot from rotating about a center axis thereof, thereby immobilizing the boot within the receptacle.

11. The security device of claim 10, wherein the biasing element is selected from the group consisting of a spring, a permanent magnet, a polymer member, a biasing tine, or a combination thereof.

12. The security device of claim 10, further comprising a magnet key configured to retract the pin into the retracted position, thereby releasing the boot.

13. The security device of claim 12, wherein the magnet key produces a magnetic field sufficient to overcome a biasing force exerted by the biasing element on the pin when the magnet key abuts the top surface of the boot.

14. The security device of claim 10, further comprising a first electric contact housed within the boot and a second electric contact housed within the base, wherein the first and the second electric contacts are in an electrical communication with one another when the boot is within the receptacle.

15. The security device of claim 14, further comprising an alarm module housed within the base or the boot, the alarm module monitoring the electrical communication between the first and the second contacts, wherein responsive to an interruption of an electrical current flow between the first and the second contacts, the alarm module generates an alarm signal.

16. The security device of claim 15, wherein the alarm signal triggers an alarm, the alarm being selected from the group consisting of a visual alarm, an audible alarm, an email, a text message, multimedia message, a facsimile, or a combination thereof.

17. The security device of claim 14, wherein the first contact is a male contact or a female port.

18. The security device of claim 10, further comprising a male plug housed within the boot and a female port housed within the base, wherein an electric contact of the male plug protrudes outside the bottom surface boot and the female port has an opening at the inner bottom surface of the receptacle, whereby the male contact enters the female port when the boot is received within the receptacle.

19. The security device of claim 10, wherein the boot comprising two mating components, whereby a housing for a wire plug is accessible when the two mating components are apart.

20. A security device comprising:

a base;

a receptacle disposed within the base, the receptacle having an inner lateral surface;

a first thread circumferentially disposed on the inner lateral surface of the receptacle;

a boot configured to be received within the receptacle, the boot having an outer lateral surface;

a channel disposed within the boot;

a second thread circumferentially disposed on the outer lateral surface of the boot, the second thread being configured to engage the first thread;

a pin housed within the base, the pin having an extended position in which the pin protrudes into the receptacle, and a retracted position in which the pin is contained within the base, the pin configured to be received within the channel;

wherein the channel and the pin are positioned with respect to the first and the second threads in locations where the channel and the pin align when the boot is screwed into the receptacle enabling the pin to enter the channel restricting the boot from rotating about a center axis thereof, thereby securing the boot within the receptacle; and a magnet key configured to retract the pin into the retracted position, thereby releasing the boot.

* * * * *